United States Patent [19]

Marzouk

[11] Patent Number: 4,966,560

[45] Date of Patent: Oct. 30, 1990

[54] COAXIAL CONNECTOR PLUG USING A CENTER CONDUCTOR SLEEVE AND SINGLE POINT CRIMPING

[75] Inventor: Fred Marzouk, Nashua, N.H.

[73] Assignee: Calcomp Inc., Anaheim, Calif.

[21] Appl. No.: 404,197

[22] Filed: Sep. 7, 1989

[51] Int. Cl.[5] ..... H01R 17/18

[52] U.S. Cl. ..... 439/585; 439/877; 29/862; 29/863

[58] Field of Search ..... 439/877, 879, 880, 578–585, 439/675, 741, 751; 29/828, 831, 834, 861, 862, 863

[56] References Cited

U.S. PATENT DOCUMENTS

| | | | |
|---|---|---|---|
| 2,983,895 | 5/1961 | Fasik | 439/581 |
| 3,112,977 | 12/1963 | Long et al. | 439/585 |
| 3,295,094 | 12/1966 | DeLyon et al. | 439/585 |
| 4,110,550 | 8/1978 | DePietro | 29/828 |
| 4,131,332 | 12/1978 | Hogindobler et al. | 439/585 |

*Primary Examiner*—David L. Pirlot

*Attorney, Agent, or Firm*—Donald A. Streck; Wm. F. Porter, Jr.

[57] ABSTRACT

This is a method and associated apparatus for electrically connecting a coaxial connector plug having a hollow cylindrical center pin inside a cylindrical conductive housing concentrically disposed about the center pin with an insulating support separating the pin and the housing to a coaxial cable having a center conductor inside a hollow conductive shield and separated therefrom by an insulating layer without the use of solder. The metod comprises the steps of:

exposing a leading portion of the center conductor and a trailing portion of the conductive shield;

sliding a hollow cylindrical conductive sleeve over the leading portion;

inserting the cable into the plug so as to insert the center conductor and the conductive sleeve into the hollow center pin and the trailing portion of the conductive shield into a cable-receiving portion of the cylindrical conductive housing;

staking the center pin at a single point so as to crimp the center pin, the sleeve and the center conductor together by deforming them in a single direction; and, crimping the cable-receiving portion of the housing and the trailing portion of the conductive shield together.

6 Claims, 1 Drawing Sheet

COAXIAL CONNECTOR PLUG USING A CENTER CONDUCTOR SLEEVE AND SINGLE POINT CRIMPING

TECHNICAL FIELD

The invention is related to coaxial cable connectors and particularly to a quick and inexpensive method for solderlessly connecting a coaxial cable to a standard RCA coaxial connector plug without using specially made parts or tools. In particular, it relates to a method of electrically connecting a coaxial connector plug having a hollow cylindrical center pin inside a cylindrical conductive housing concentrically disposed about the center pin with an insulating support separating the pin and the housing to a coaxial cable having a center conductor inside a hollow conductive shield and separated therefrom by an insulating layer without the use of solder comprising the steps of, exposing a leading portion of the center conductor and a trailing portion of the conductive shield; sliding a hollow cylindrical conductive sleeve over the leading portion; inserting the cable into the plug so as to insert the center conductor and the conductive sleeve into the hollow center pin and the trailing portion of the conductive shield into a cable-receiving portion of the cylindrical conductive housing; staking the center pin at a single point so as to crimp the center pin, the sleeve and the center conductor together by deforming them in a single direction; and, crimping the cable-receiving portion of the housing and the trailing portion of the conductive shield together.

BACKGROUND OF THE INVENTION

Coaxial cable connectors are well-known in the art, as exemplified in U.S. Pat. Nos. 3,551,882; 4,580,862; 4,445,745; 4,116,521; 2,958,845 and 3,227,993. Typically, the coaxial cable connectors disclosed in the foregoing patents each require a number of specially made parts and therefore are relatively expensive, a significant disadvantage. One technique used in such coaxial cable connectors is to crimp parts of the connector around either or both the center conductor and shield of the coaxial cable, as disclosed in U.S. Pat. Nos. 2,941,028; 3,221,290; 4,010,538; 3,728,787; 3,539,976; 4,070,751; 4,019,802; 4,131,332; 4,053,200; 4,135,776 and 4,619,496. Those connectors that crimp the cable center conductor are specially made and circumferentially crimp the conductor. Such circumferential crimping requires precision and special tooling, also a significant disadvantage.

One of the simplest connectors is the standard so-called "RCA plug" 100 illustrated in FIG. 1 originally manufactured and sold by the Radio Corporation of America (RCA), New York, N.Y. for use in connecting phonograph turntables to an associated amplifier (also often referred to simply as a "phono plug"). The phono plug 100 is a very inexpensive standard plug, comprising a hollow cylindrical center pin 105 firmly held in an annular insulating separator 110. The annular separator 110 is firmly held in the interior of an outside cylindrical conductor housing 115. The conductor housing 115 has a rear hollow cable-receiving cylindrical portion 120 characterized by a smaller radius through which the coaxial cable 130 is inserted. While the connector plug 100 enjoys the advantage of simplicity, it suffers from the disadvantage of requiring two solder joints for connection to a cable, as illustrated in FIG. 2. A coaxial cable 130 is prepared for connection to the plug 100 by partially stripping its braided conductive shield 135 and its cylindrical insulating sleeve 140 so as to expose a leading portion of its center conductor 145. The cable 130 is then inserted through the rear portion 120 of the plug 100 as shown in FIG. 2 until the front edge of the insulating sleeve 140 abuts an annular flange 107 of the center pin 105 so that the center conductor 145 slightly protrudes through a center hole **105*a* in the tip of the center pin 105. Solder joints 150 and 155 are then made near the center pin hole 105*a* and the edge of the rear portion 120, respectively. The first solder joint 150 connects the center conductor 145 to the center pin 105, while the second solder joint 155 connects the braided shield 135 to the connector housing 115. Making the two solder joints 150, 155 is relatively time-consuming and is subject to error. Unfortunately, without the solder joints, the connection between the cable 130 and the plug 100 would not be reliable. Thus, there appears to be no way to achieve a reliable connection between the cable 130 and the plug 100** without the time consuming soldering step.

It is therefore an object of the invention to provide a method for connecting a standard phono type connector plug to a coaxial cable in a single easy step.

It is a further object of the invention to provide a method for reliably connecting a standard phono type connector plug to a coaxial cable without soldering.

It is a yet further object of the invention to provide a method for connecting a standard phono type connector plug to a coaxial cable using a sleeve around the cable center conductor inside the plug's hollow center pin and a staking tool to crimp the sleeve between the center pin and the center conductor in a single action.

Other objects and benefits of the invention will become apparent from the description which follows hereinafter when taken in conjunction with the drawing figures which accompany it.

SUMMARY OF THE INVENTION

The foregoing objects have been achieved in a coaxial connector plug having a hollow cylindrical center pin inside a cylindrical conductive housing concentric with the center pin and an insulating support separating the pin and the housing by the improvement of the present invention for permitting non-soldered electrical connection of the plug to a coaxial cable having a center conductor inside a hollow conductive shield and separated therefrom by an insulating layer, a leading portion of the center conductor being exposed, the cable being inside the plug and the leading portion of the center conductor being inside the hollow center pin, said improvement comprising a hollow cylindrical conductive sleeve disposed around the leading portion of the center conductor and inside the hollow center pin whereby a single point first crimp joining the center pin, the sleeve and the center conductor together and a second crimp joining the housing and the conductive shield together electrically connects the plug to the cable.

DETAILED DESCRIPTION OF THE PREFERRED EMBODIMENT

Figure 2:
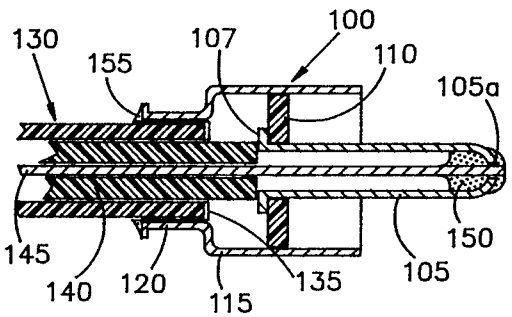
PRIOR ART FIG. 2
FIG. 2 is a simplified cross-sectional view corresponding to FIG. 1 illustrating the cable and plug of FIG. 1 connected together by soldering as is the standard prior art approach.
Figure 1:
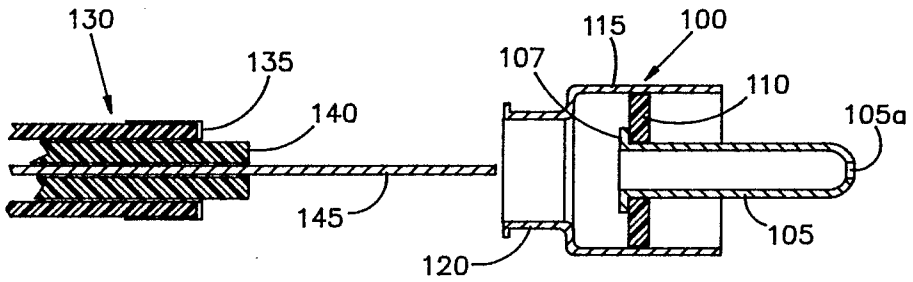
PRIOR ART FIG. 1
FIG. 1 is a simplified cross-sectional view illustrating a coaxial cable and a standard phono type cable plug of the prior art.
Figure 3:
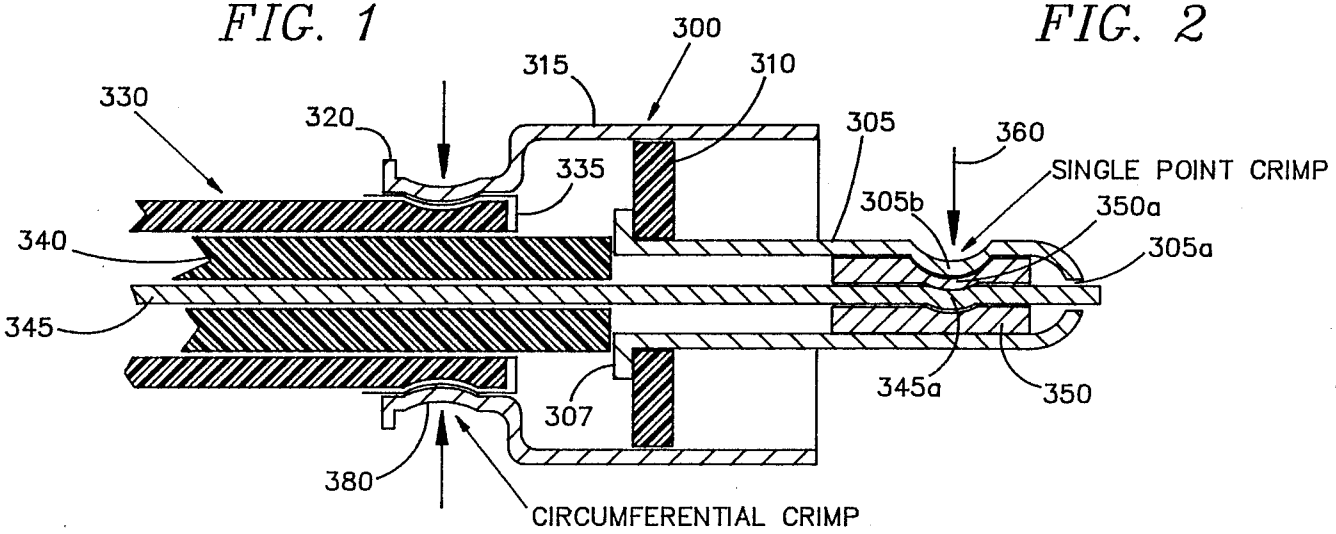
FIG. 3 is a simplified cross-sectional view illustrating the standard cable plug of FIGS. 1 and 2 connected to a coaxial cable in accordance with the method of the present invention in which the plug center pin and the cable center conductor with a sleeve disposed thereover are crimped together at a single point.

Referring to FIG. 3, a standard coaxial cable connector plug 300, identical to the type of plug 100 illustrated in FIGS. 1 and 2, includes a hollow cylindrical center pin 305, an annular insulator 310 and a conductive housing 315 having a rear cable-receiving portion 320. A coaxial cable 330, identical to the type of cable 130 illustrated in FIGS. 1 and 2, includes a braided conductive shield 335, a cylindrical insulating sleeve 340 and a center conductor 345. As illustrated in FIG. 3, in preparation for connecting the plug 300 to the cable 330 according to the present invention, the coaxial cable 330 is first prepared for connection to the plug 300 in the same manner described previously in reference to FIG. 1, i.e. by exposing a leading portion of the cable center conductor 345. Prior to inserting the cable 330 through the rear plug portion 320, however, the cable center conductor 345 is inserted into a conductive hollow cylindrical sleeve 350. The inner diameter of the sleeve 350 is slightly larger than the outer diameter of the cable center conductor 345 while the outer diameter of the sleeve 350 is slightly smaller than the inner diameter of the hollow center pin 305. Thus, the sleeve 350 fits closely between the center conductor 345 and the interior surface of the hollow center pin 305. Preferably, the sleeve 350 easily slides around the center conductor 345 and through the interior of the hollow center pin 305.

Preferably, the cable 330 is then inserted far enough into the plug 300 so that the center conductor 345 at least partially protudes into the center pin tip hole 305*a*. This verifies that the cable 330 has been inserted a sufficient distance to assure a good connection. No solder is then applied, however. Instead, a single point crimp 360 is made using one of the simple staking tools of a type well known in the art. As a result, single point depressions 305*b*, 350*a* and 345*a* are formed in mutual registration in the plug center pin 305, the sleeve 350 and the cable center conductor 345, respectively and nest within one another. The single point crimp 360 is preferably formed with a single impact action of the staking tool or the like, so that the step for solderlessly connecting the center pin 305 to the center conductor 345 is virtually instantaneous in most cases.

The method for making the connection illustrated in FIG. 3 is preferably one in which the exposed leader of the cable center conductor 345 is first inserted into the conductive sleeve 350 and then the center conductor 345 and the sleeve 350 are inserted together as a unit into the hollow center pin 305 as the cable 330 is inserted into the plug 300. Alternatively, the sleeve 350 may first be inserted into the center pin 305 and then the exposed leader of the center conductor 345 may be inserted into the sleeve 350. In yet another variation, the sleeve 350 may be inserted into the center pin 305 simultaneously as the center conductor 305 is inserted into the sleeve 350.

The cable's exposed outer conductive braided shield 335 is also solderlessly connected to the plug conductive housing 315 by inwardly crimping the rear cable-receiving portion 320 of the housing 315 holding the exposed shield 335 so as to pinch the shield 335 against the insulator 340. In the preferred embodiment of the invention, this is done by circumferentially crimping the rear housing portion 320 to form a circumferential crimp 380.

As can thus be appreciated, in a production environment the present invention provides a significant improvement since a simple and cheap phono type connector can be used in a manner which provides a quick and sure electrical connection of the components while assuring that the soft plastic insulating portions of the cable are not damaged through the application of excessive heat during a soldering process.

Wherefore, having thus described the invention, what is claimed is:

1. In a coaxial connector plug having a hollow cylindrical center pin inside a cylindrical conductive housing concentrically disposed about the center pin with an insulating support separating the pin and the housing, an improved method for connecting the plug to a coaxial cable having a center conductor inside a hollow conductive shield and separated therefrom by an insulating layer in which a leading portion of the center conductor is exposed and wherein the cable is inserted into the plug so as to insert the leading portion of the center conductor inside the hollow center pin, the method comprising the steps of:

(a) sliding a hollow cylindrical conductive sleeve over the leading portion of the center conductor after the leading portion has been exposed, wherein one end of the hollow cylindrical center pin is disposed inside the housing and has an annular rear flange around an axial opening therein through which the center conductor is inserted and wherein the other end of the center pin comprises a closed tip having an opening therein;

(b) inserting the cable into the plug so as to insert the center conductor and the conductive sleeve into the hollow center pin by inserting the cable through the cable-receiving portion until a leading edge of the insulating layer of the cable abuts the annular rear flange of the center pin so as to insert a tip of the leading portion of the center conductor adjacent the opening in the tip of the center pin;

(c) staking the center pin at a single point so as to crimp the center pin, the sleeve and the center conductor together by deforming them in a single direction; wherein the conductive housing of the plug comprises a hollow cylindrical main portion at least partially surrounding the center pin with the hollow cylindrical cable-receiving portion concentric with the main portion and surrounding a leading portion of the shield and additionally comprising, (d) exposing a trailing portion of the conductive shield;

(e) inserting the exposed trailing portion into a rear cable-receiving portion of the housing; and, (f) circumferentially crimping the cable-receiving portion and the shield together so as to bend opposing parts of the cable-receiving portion and of the shield towards one another in opposing directions whereby to crimp the rear cable-receiving portion of the housing and the conductive shield together.

2. The method of claim 1 wherein said step of staking the center pin at a single point comprises the steps of:

(a) forming a first single point depression in the center pin;

(b) forming a second single point depression in the conductive sleeve;

(c) forming a third single point depression in the center conductor; and, (d) placing the first, second and third single point depressions in mutual registration so as to nest within one another.

3. The method of claim 1 wherein:

said step of inserting the cable into the plug is performed before or simultaneously with said step of sliding a hollow cylindrical conductive sleeve over the leading portion of the center conductor.

4. The method of electrically connecting a coaxial connector plug having a hollow cylindrical center pin inside a cylindrical conductive housing concentrically disposed about the center pin with an insulating support separating the pin and the housing to a coaxial cable having a center conductor inside a hollow conductive shield and separated therefrom by an insulating layer without the use of solder, wherein the conductive housing of the plug comprises a hollow cylindrical main portion at least partially surrounding the center pin with a hollow cylindrical cable-receiving portion concentric with the main portion and surrounding a leading portion of the shield, and one end of the hollow cylindrical center pin is disposed inside the housing and has an annular rear flange around an axial opening therein through which the center conductor is inserted, and the other end of the center pin comprises a closed tip having an opening therein, said method comprising the steps of:

(a) exposing a leading portion of the center conductor and a trailing portion of the conductive shield;

(b) sliding a hollow cylindrical conductive sleeve over the leading portion;

(c) inserting the cable into the plug so as to insert the center conductor and the conductive sleeve into the hollow center pin and the trailing portion of the conductive shield into a cable-receiving portion of the cylindrical conductive housing by inserting the cable through the cable-receiving portion until a leading edge of the insulating layer of the cable abuts the annular rear flange of the center pin so as to insert a tip of the leading portion of the center conductor adjacent the opening in the tip of the center pin;

(d) staking the center pin at a single point so as to crimp the center pin, the sleeve and the center conductor together by deforming them in a single direction; and, (e) crimping the cable-receiving portion of the housing and the trailing portion of the conductive shield together by circumferentially crimping the cable-receiving portion and the shield together so as to bend opposing parts of the cable-receiving portion and of the shield towards one another in opposing directions.

5. The method of claim 4 wherein said step of staking the center pin at a single point comprises the steps of:

(a) forming a first single point depression in the center pin;

(b) forming a second single point depression in the conductive sleeve;

(c) forming a third single point depression in the center conductor; and, (d) placing the first, second and third single point depressions in mutual registration so as to nest within one another.

6. The method of claim 4 wherein:

said step of inserting the cable into the plug is performed before or simultaneously with said step of sliding a hollow cylindrical conductive sleeve over the leading portion of the center conductor.

* * * * *